United States Patent [19]

Mady et al.

[11] Patent Number: 4,497,668

[45] Date of Patent: Feb. 5, 1985

[54] PHOSPHATING PROCESS FOR ZINC-PLATED METALS

[75] Inventors: Raschad Mady, Pulheim; Winand Hanelt, Düren; Roland Morlock, Bergheim; Dieter Geruhn, Werl; Lutz Leyhe, Witten-Heven; Jobst H. Meyer zu Bexten, Soest-Ostönnen; Franz Ricke, Schwelm; all of Fed. Rep. of Germany

[73] Assignee: Gerhard Collardin GmbH, Cologne, Fed. Rep. of Germany

[21] Appl. No.: 554,879

[22] Filed: Nov. 25, 1983

[30] Foreign Application Priority Data

Dec. 8, 1982 [DE] Fed. Rep. of Germany ..... 3245411

[51] Int. Cl.[3] ..... C23F 7/08

[52] U.S. Cl. ..... 148/6.15 Z

[58] Field of Search ..... 148/6.15 Z

[56] References Cited

U.S. PATENT DOCUMENTS 3,625,777 12/1971 Okabe et al. ..... 148/6.15

3,810,792 5/1974 Ries et al. ..... 148/6.15

4,389,260 6/1983 Hauffe ..... 148/6.15 Z

FOREIGN PATENT DOCUMENTS 1257947 12/1971 United Kingdom .

1376310 4/1974 United Kingdom ..... 148/6.15 Z

*Primary Examiner*—Sam Silverberg

*Attorney, Agent, or Firm*—Ernest G. Szoke; Henry E. Millson, Jr.; Mark A. Greenfield

[57] ABSTRACT

A process for phosphating zinc-plated metal articles, particularly electrolytically zinc-plated steel sheets, by treatment thereof for a short period with an acidic phosphating solution which, in addition to zinc and phosphate ions, can contain other metal cations and/or anions of oxygen-containing acids having an accelerating effect, wherein the phosphating solution has a content of $Zn^{2+}$-cations of between about 1 and 2.5 g/l, a free acid content in the range from 0.8 to 3 points, and the acid ratio of total acid to free acid in the range from 5 to 10. The phosphating treatment is carried out for a period of time not in excess of about 5 seconds.

20 Claims, No Drawings

PHOSPHATING PROCESS FOR ZINC-PLATED METALS

This invention relates to an improved process for producing coherent, finely crystalline zinc phosphate layers having a low weight per unit area in very short treatment times on zine-plated metal products, particularly on electrolytically zinc-plated ferrous metals such as electrolytically zinc-plated steel sheets.

BACKGROUND OF THE INVENTION

Processes currently used in practice for phosphating zinc surfaces, for example electrolytically zinc-plated steel strip, still have certain limitations which would be desirable to eliminate. Thus, to guarantee adequate protection against corrosion, it is regarded as necessary for the phosphate layers to have weights per unit area of from about 2 to about 3 g/m$^2$. These comparatively high weights per unit area frequently result in unsatisfactory or poor adhesion of subsequently applied layers, particularly when a phosphated and siccative coated material is subjected to forming processes. In the phosphating processes used in practice, the phosphating treatment lasts more than 5 seconds. With the processes used heretofore, it would be very difficult or even impossible to shorten the phosphating time, for example by increasing the speed of travel of the strips from 60 to 120 m/minute. Potential faults would include, for example, breaks in the phosphate layer applied and, hence, poorer protection against corrosion, and unsatisfactory forming and lacquer adhesion properties. Treatment times in the phosphating stage of less than 5 seconds cannot be obtained with the known processes used in practice.

GB Pat. No. 1,257,947, which relates to a process for applying thin, corrosion-resistant and firmly adhering zinc phosphate coatings to metal surfaces, proposes treating these metal surfaces, which have been galvanized, with an acidic solution to which has been added at least one carbohydrate consisting of starch, a starch derivative or a polysaccharide produced by the acidic decomposition of starch or a starch derivative. By spraying on phosphating solutions of this type, uniform zinc phosphate coatings having a low weight per unit area of, for example, from 1.2 to 1.8 g/m$^2$ are said to be obtained over a period of from 3 to 10 seconds. The use of starch, starch derivatives or polysaccharides in the phosphating bath gives rise to considerable practical difficulties. These organic constituents are decomposed by the temperature and pH-value of the bath as the bath increases in age. The initially light phosphate coatings accordingly become distinctly heavier. The decomposition products release a strong odor. Extremely heavy sludge formation occurs which is particularly undesirable.

For forming thin, coherent phosphate coatings having a weight per unit area of less than 1.0 g/m$^2$, U.S. Pat. No. 3,810,792 proposes treating the metal surfaces with solutions containing nickel ions as layer-forming cations. Layer-forming cations of another divalent metal, particularly zinc ions, can also be present in addition to the nickel ions. In the latter case, however, the molar ratio of nickel ions to the other divalent metal cations is distinctly greater than 1 whereas it is known that Ni:Zn ratios should be in the range of from 1:0.001 to 1:0.7. Using the solutions of this patent, mostly nickel phosphate layers are deposited. Accordingly, the zinc phosphate layers required in practice are not formed. In addition, the thin nickel phosphate layers obtained according to this patent are subject to serious limitations. Thus, they always have to be subsequently overcoated with other coating compositions to obtain adequate protection of the metal substrate.

The demand for improved protection against corrosion has today resulted in an increase in the use of electrolytically zinc-plated steel for many industrial products. At the same time, efforts are constantly being made in practice to operate existing installations at higher speeds for economic reasons. In the case of the processes currently used for phosphating electrolytically zinc-plated steel, these shortened treatment times have resulted in a distinct deterioration in the phosphate layer produced.

DESCRIPTION OF THE INVENTION

Accordingly, an object of the present invention is to form high-quality, improved zinc phosphate layers on zinc-plated metals, especially electrolytically zinc-plated metals, and particularly zinc-plated ferrous metals, despite considerably shortened treatment times in the phosphating stage. In achieving this object, the invention intentionally sets out to accept low weights per unit area of the phosphate coatings while at the same time producing a uniform coverage of the zinc-plated material with a finely crystalline, firmly adhering coherent zinc phosphate layer. Using the process according to the invention, it is possible for example to form on electrolytically zinc-plated steel sheets, in a treatment time of at most about 5 seconds, uniform, coherent phosphate layers which have weights per unit area lower by half compared with known processes but which, at the same time, guarantee a level of protection against corrosion which at least approximates that obtained with so-called "thick-layer phosphating", but which in other properties exhibits considerable advantages over the known thicker phosphate layers. For example, the adhesion of organic coatings during and after forming operations such as beveling, deep drawing, flanging and the like, is improved over the hitherto obtainable results. In addition, the present invention provides a uniform quality of the phosphate coating across this entire range, and particularly at high strip speeds, i.e. at strip speeds of for example from 100 to 120 m/minute.

Accordingly, the present invention relates to a process for phosphating electrolytically zinc-plated metal products, particularly electrolytically zinc-plated steel strip, by brief treatment with acidic phosphating solutions which, in addition to zinc and phosphate ions, can contain other metal cations and/or anions of oxygen-containing acids having an accelerating effect to form zinc phosphate layers having a weight per unit area of less than 2 g/m$^2$; wherein the phosphating treatment is carried out with acidic phosphating solutions having a content of $Zn^{2+}$-cations of from about 1 to about 2.5 g/l, a free acid content in the range of from about 0.8 to about 3 points, and an acid ratio of total acid to free acid in the range of from about 5 to about 10, with the treatment of the electrolytically zinc-plated material with the phosphating solution not lasting longer than about 5 seconds.

The process according to the invention provides zinc phosphate coatings which have a weight per unit area of from about 0.6 to about 1.9 g/m$^2$, and a coherent, finely crystalline structure and which provide the electrolytically zinc-plated sheet with a desirable, uniform light gray appearance. An electrolytically zinc-plated steel strip phosphated in this way can be further processed even without subsequent lacquering. The thin phosphate layers produced by the process of the invention behave more favorably in numerous forming operations than the heavier phosphate layers produced by hitherto known processes. Also, subsequently applied organic coatings show distinctly improved adhesion both during and also after forming operations in comparison with those of the prior art.

It should be understood that while electrolytically zinc-plated metals are particularly suitable for treatment by the present process, other zinc-plated metals can be employed, such as those resulting from hot dipping.

The free acid content of the phosphating bath used in accordance with the invention is preferably in the range of from about 1.2 to about 1.8 points. The preferred acid ratio of total acid to free acid is in the range of from about 6 to about 8. Definitions of the terms "free acid" and "total acid" and of the "primary phosphates" in phosphating baths, as mentioned hereinafter, can be found in prior-art literature, for example, in the Article by Christian Ries entitled "Uberwachung von phosphatierungsbadern (Monitoring Phosphating Baths)" Galvanotechnik, 59 (1968) No. 1, pages 37 to 39 (Eugen G. Leuze Verlag, Saulgau (Wurtt)). The above parameters and also their determination are described in detail in this publication. Briefly, the point count of the free acid is defined as the number of milliliters of 0.1N NaOH required for titrating 10 ml of bath solution using dimethyl yellow, methyl orange, or bromphenol blue indicator. The total acid point count is the number of milliliters of 0.1N NaOH required for the first signs of pink to appear in the titration of 10 ml of bath solution using phenolphthalein as indicator.

The following combination of parameters are essential to the process of the invention:

1. The concentration of $Zn^{2+}$-ions, must be kept at a low level as set forth above. This is an important requirement for the formation of the desired thin but uniformly coherent layers.

2. A comparatively high free acid content is used in the bath solution, as indicated above.

3. Finally, the treatment time is deliberately kept short, i.e. not significantly more than 5 seconds. In general, the treatment time is between about 2.5 and about 5 seconds.

Investigations of the formation and conversion of the phosphate coating formed in accordance with the invention have revealed the interesting fact that, under the effect of the bath and process parameters selected in accordance with the invention, including the effect of the high free acid content, initially a very rapid build up of the zinc phosphate layer occurs, which subsequently diminishes even within the short treatment times of the present process. In the present process, the weight of the phosphate coating appears initially to pass through a maximum value, decreasing again in the later stages of the process, i.e. over a period of about 3 to 5 seconds.

The zinc phosphate layers produced by the present process have weights per unit area of preferably from about 0.6 to about 1.8 $g/m^2$ and, more preferably, in the range of from about 1.2 to about 1.4 $g/m^2$.

The other components of the phosphating solutions to be used in the practice of the invention are known from the prior art. Thus, nitrate is particular useful as the anion of an oxygen-containing acid having an activating effect. When nitrate is employed, the ratio by weight of $Zn^{2+}$ to $NO_3^-$ is preferably in the range of from 1 to (1–8). In addition, the phosphate and nitrate contents of the phosphating bath are best coordinated with one another in such a way that the ratio by weight of $PO_4^{3-}$ to $NO_3^-$ is in the range of from 1 to (0.1–2.5). It is also preferred to select the ratio of zinc cations to primary phosphate in such a way that ratios by weight of $Zn^{2+}$ to $H_2PO_4^-$ of from 1 to (1–8) are maintained in the treatment bath.

In addition to zinc, other cations can also be used in the process of the invention. However, they are generally used in small amounts. Thus, it is possible to add small quantities of $Ni^{2+}$-ions, although preferably the zinc ion content always predominates. Mixing ratios of from 2 to 20 parts by weight of $Zn^{2+}$-ions to 1 part of $Ni^{2+}$-ions, for example, is particularly useful. In this connection, it is interesting that, in general, nickel cannot be analytically detected in the zinc phosphate coatings deposited by the process of the invention. Accordingly, nickel is present in the phosphate coating at most in traces which lie below the detectable limit.

The phosphating treatment is best carried out at moderate temperatures, more particularly at temperatures in the range of from about 50° to about 70° C., with temperatures in the range of from about 60° to about 65° C. being particularly suitable. The treatment solution can be applied by any technically suitable method. Accordingly, it is possible to carry out the present process by spray coating, by dip coating, or by a combination of spray coating and dip coating.

Before the phosphating solution is applied, the electrolytically zinc-plated surface must be completely wettable with water. This requirement is met in continuously operating commercial bath lines. If the surface of the electrolytically zinc-plated strip is oiled for the purposes of storage and corrosion prevention, the oil should be removed before phosphating using known preparations and techniques. Thereafter, the water-wettable electrolytically zinc-plated metal surface is preferably subjected to a known activating pre-treatment before the phosphating solution is applied. Suitable pretreatment processes are described, in particular, in German Application Nos. 20 38 105 and 20 43 085. In these pretreatment processes, the metal surfaces to be subsequently phosphated are treated with solutions containing as the activating agent a titanium salt and sodium phosphate together with organic components, such as gelatin or alkali salts of polyuronic acids. Soluble compounds of titanium, such as potassium titanium fluoride and, in particular, titanyl sulfate, can be used with advantage as the titanium component. The sodium phosphate generally used is disodium orthophosphate, although it may be completely or partly replaced by other sodium phosphates, such as monosodium orthophosphate, trisodium orthophosphate, tetrasodium pyrophosphate and sodium tripolyphosphate. The titanium-containing compounds and sodium phosphate are used in such quantitative ratios that the titanium content amounts to at least 0.005% by weight, based on the weight of the titanium-containing compounds and the sodium phosphate.

As described in the prior art (for example in U.S. Pat. No. 3,810,792), it can also be of advantage to the process of the invention and to the zinc phosphate layers produced by the process of the invention to passivate the phosphate layers produced in a following process step. Passivation can be carried out for example with dilute chromic acid and/or phosphoric acid. The concentration of the chromic acid and/or phosphoric acid is generally in the range of from 0.1 to 1.0 g/l. In this connection, it is possible to aftertreat the protective layers with dilute chromic acid containing chromium-(III)ions. In this instance, the hexavalent chromium is generally used in concentrations of from 0.2 to 4.0 g/l of $CrO_3$ and the trivalent chromium in concentrations of from 0.5 to 7.5 g/l of $Cr_2O_3$. Between the phosphating step and the aftertreatment step, the phosphate coatings are preferably rinsed with water. However, this rinsing step is not absolutely essential and may be omitted, particularly when squeezing rollers are used.

The process according to the invention is illustrated by the following examples which are given for that purpose only and not to limit the invention.

EXAMPLE 1

An electrolytically zinc-plated surface was treated for 3–5 seconds at 40° C. with a solution containing a titanium phosphate-based activating agent of the type described in German Application No. 20 38 105 in a quantity of 3 g/l. The activated surface was then treated by dipping at 60° C. with a solution having the following composition: 1.1 g/l of $Zn^{2+}$ added as ZnO, 0.4 g/l of $Ni^{2+}$ added as $NiCO_3$, 7.4 g/l of $PO_4^{3-}$ added as $H_3PO_4$, 2.1 g/l of $NO_3^-$ added as $NaNO_3$, 3 mg/l of $Fe^{2+}$ added as $FeSO_4.7H_2O$. The free acid content was 1.3 points and the total acid content was 10.8 points. (The points of free acid and total acid represent the number of milliliters of 0.1N NaOH required for titrating 10 ml of bath solution against bromphenol blue or phenolphthalein respectively as the indicator.) After a phosphating time of 3.5 seconds, the sheet was rinsed with water, passivated at 50° C. with a solution containing 1.2 g/l of $Cr^{6+}$ and 0.7 g/l of $Cr^{3+}$ and then dried.

The phosphate coating had a weight per unit area of 1.6 g/m$^2$. The results of the corrosion prevention test carried out in accordance with SS DIN 50021 (ASTM 117/73) were comparable with those obtained with conventionally produced layers having a weight per unit area of 2.4 to 2.6 g/m$^2$ and which were prepared by treating a fresh sample of the above electrolytically zinc-plated surface with a phosphating solution containing 8.6 g/l of $H_2PO_4^-$ added as $H_3PO_4$, 1.8 g/l of $NO_3^-$ added as $NH_4NO_3$, 4 g/l $Zn^{2+}$ added as ZnO, and 1 g/l of $Ni^{2+}$ added as $NiCO_3$. The treatment temperature was 55° C., the temperature time was 8 seconds, and the solution had a free acid content of 2.0 points and a total acid content of 22.3 points.

EXAMPLE 2

A phosphating solution was prepared and applied at 63° C. to an electrolytically zinc-plated steel sheet. The phosphating bath had the following composition: 1.80 g/l of $Zn^{2+}$ added as ZnO, 0.35 g/l of $Ni^{2+}$ added as $NiCO_3$, 5.50 g/l of $PO_4^{3-}$ added as $H_3PO_4$, 4.8 g/l of $NO_3^-$ added as $NaNO_3$. The total acid content of the bath was 9.9 points and its free acid content was 1.4 points. An electrolytically zinc-plated sheet was phosphated with this solution for 5 seconds by spraying. Thereafter the sheet was covered by a coherent, light gray phosphate layer with a weight per unit area of 1.3 g/m$^2$.

During subsequent bending through 90° and 180°, the phosphate layer did not crack or peel.

A sample of the sheet was lacquered and, after drying at elevated temperature, was subjected to the lattice cut test according to DIN 53151. The adhesion value was satisfactory both with and without the 8 mm Erichsen indentation.

EXAMPLE 3

A freshly electrolytically zinc-plated steel sheet was activated at 40° C. for 3–5 seconds with a solution which contained 1.5 g/l of a titanium phosphate-containing component and which had a pH-value of 8.5 in fully deionized water. The zinc-plated surface was then phosphated for 4 seconds by spraying at 60° C. with a solution having the following composition: 2.0 g/l of $Zn^{2+}$ added as $ZnCO_3$, 0.4 g/l of $Ni^{2+}$ added as $NiCO_3$, 4.95 g/l of $PO_4^{3-}$ added as $H_3PO_4$, 6.0 g/l of $NO_3^-$ added as $NaNO_3$. The free acid content of the bath was 2.1 points and its total acid content was 11.3 points. In this case, too, the sheet had a uniform light gray appearance. The phosphate layer formed was coherent and had a weight per unit area of 1.1 g/m$^2$. A commercial polyester based coil coating lacquer (Wiedocoil-Polyester ESH 10268/MF 311, Fa. Hermann Wiederhold GmbH, 4010 Hilden, Deutschland) was applied to the phosphated sheet. Lacquer adhesion to this sheet was good.

A fresh sample of the above electrolytically zinc-plated sheet was phosphated by a conventional process (weight per unit area of the phosphate layer 2.3 g/m$^2$), i.e. by treatment with a phosphating solution containing 7.8 g/l of $PO_4^{3-}$ added as $H_3PO_4$, 3.2 g/l of $Zn^{2+}$ added as $ZnCO_3$, 0.9 g/l of $Ni^{2+}$ added as $NiCO_3$, and 1.5 g/l of $NO_3^-$ added as $HNO_3$. The treatment temperature was 56° C., the treatment time was 6 seconds, the free acid content of the solution was 2.4 points, and the total acid content was 22.8 points. The phosphated sheet was then coated with the same lacquer and subjected to the same forming operation. The lacquer adhesion values are distinctly poorer than those obtained with the sheet phosphated by the process according to the invention, i.e. the Cross Hatch test combined with an Erichsen cupping of 7 mm produced almost no loss of lacquer with the above sheet phosphated by the process of the invention, while the sheet phosphated by the above conventional process showed extensive separation of the lacquer.

What is claimed is:

1. A process for phosphating a zinc-plated metal article comprising contacting said zinc-plated metal article with a phosphating solution consisting essentially of zinc ions and phosphate ions wherein (a) from about 1 to about 2.5 g/l of zinc ions are present, (b) the free acid content thereof is in the range of from about 0.8 to about 3 points, (c) the ratio of total acid to free acid is in the range of from about 5 to about 10, and wherein the contact time is not longer than about 5 seconds.

2. A process in accordance with claim 1 wherein the process is carried out at a temperature in the range of from about 50° to about 70° C.

3. A process in accordance with claim 2 wherein the temperature is in the range of from about 60° to about 65° C.

4. A process in accordance with claim 1 wherein the phosphating solution also contains an accelerating quantity of an anion of an oxygen-containing acid.

5. A process in accordance with claim 1 wherein said anion is the nitrate ion.

6. A process in accordance with claim 5 wherein the ratio by weight of zinc ion to nitrate ion in the solution is 1: (1–8).

7. A process in accordance with claim 6 wherein the ratio by weight of phosphate ion to nitrate ion is 1: (0.1–2.5).

8. A process in accordance with claim 1 wherein the $H_2PO_4^-$ion is present in the solution and the ratio by weight of zinc ion to $H_2PO_4^-$ion is 1: (1–8).

9. A process in accordance with claim 7 wherein the $H_2PO_4^-$ion is present in the solution and the ratio by weight of zinc ion to $H_2PO_4^-$ion is 1:(1–8).

10. A process in accordance with claim 1 wherein in (b) the free acid content is in the range of from about 1.2 to about 1.8 points, and in (c) the ratio of total acid to free acid is in the range of from about 6 to about 8.

11. A process in accordance with claim 1 wherein the process results in a phosphate layer having a thickness of from about 0.6 to about 1.9 $g/m^2$.

12. A process in accordance with claim 11 wherein the phosphate layer has a thickness of from about 1.2 to about 1.4 $g/m^2$.

13. A process in accordance with claim 1 wherein the contact time is from about 2.5 to about 5 seconds.

14. A process in accordance with claim 1 wherein nickel ion is also present in the solution in an amount of 1 part by weight of nickel to from about 2 to about 20 parts by weight of zinc ion.

15. A process in accordance with claim 1 wherein the zinc-plated metal article is an electrolytically zinc-plated metal article.

16. A process in accordance with claim 15 wherein the metal article is ferrous based.

17. A process in accordance with claim 16 wherein said article is in the form of a metal sheet or strip.

18. A process in accordance with claim 1 wherein the zinc-plated metal article is treated with a pretreatment composition containing a titanium salt.

19. A process in accordance with claim 1 wherein following the contact with the phosphating solution the zinc-plated metal article is passivated with a chromic acid and/or phosphoric acid passivating solution.

20. A process in accordance with claim 18 wherein following the contact with the phosphating solution the zinc-plated metal article is passivated with a chromic acid and/or phosphoric acid passivating solution.

* * * * *